United States Patent [19]

Ushler

[11] Patent Number: 4,960,395

[45] Date of Patent: Oct. 2, 1990

[54] CONICAL TWIST-LOCK ELECTRICAL CONNECTOR

[76] Inventor: Richard P. Ushler, 11346 Farlin St., Los Angeles, Calif. 90049

[21] Appl. No.: 367,983

[22] Filed: Jun. 19, 1989

[51] Int. Cl.[5] ..... H01R 4/50

[52] U.S. Cl. ..... 439/864; 439/889

[58] Field of Search ..... 285/404; 174/7, 845, 174/885, 945; 403/348, 349, 352, 378, 379; 439/345, 346, 359, 783, 784, 791, 792, 807, 810, 814, 863, 889

[56] References Cited

U.S. PATENT DOCUMENTS

| | | | |
|---|---|---|---|
| 2,590,789 | 3/1952 | Noyes | 439/864 |
| 2,767,384 | 10/1956 | Burke | 439/864 |
| 3,297,975 | 1/1967 | Pope | 439/889 |
| 4,212,559 | 7/1980 | Persson | 403/379 |
| 4,778,413 | 10/1988 | Saarinen | 439/803 |

*Primary Examiner*—Eugene F. Desmond
*Assistant Examiner*—Walter G. Hanchuk
*Attorney, Agent, or Firm*—J. E. McTaggart

[57] ABSTRACT

For reliable heavy duty repeatable connection of heavy duty electric power lines of a portable, mobile or temporary nature, involving frequent changes such as extension or relocation, the connector of this invention couples readily in a twist action which locks large area contact surfaces together uniformly and positively to eliminate the risk of accidental uncoupling, degration over time with repeated usage, and general unreliability experienced in non-locking type connectors of known art in this class of service. An uncomplicated rugged configuration, machined from brass, provides mating cone-shaped contact surfaces. A specially located steel pin incorporated into the socket member engages a thread groove in the plug member including a lead-in ledge to clear the pin and guide it into the groove during twist-locking. Inclined plane clamping compensates for any material wear and thus automatically maintains constant contact pressure despite frequent operation in rigorous usage over time, while a wiping effect acting uniformly over the total contact area during each coupling and decoupling preserves the integrity of the contact surfaces; thus this connector achieves excellent overall performance, reliability and life expectancy.

7 Claims, 2 Drawing Sheets

CONICAL TWIST-LOCK ELECTRICAL CONNECTOR

FIELD OF THE INVENTION

This invention relates to connectors for end to end coupling of electrical cables, particularly relating to usage with high power loads of a temporary or mobile nature, requiring frequent decoupling and recoupling, for example as required in motion picture production, stage lighting and the like.

BACKGROUND OF THE INVENTION

Conventional connectors for the type of service addressed by this invention typically utilize mating parts having a plug member with a contact portion of substantially cylindrical shape for insertion into a cylindrical cavity in a socket member. Because of the working clearance required, solid plug contact configurations fail to make a positive electrical contact and are easily uncoupled by accident; therefore, the cylindrical plug contact is usually made in a bifurcated configuration, typically prestressed by spreading the two halves apart slightly in an attempt to maintain positive retention force between the plug contact and the wall of the cavity. This type of connector has proven unsatisfactory under the rigors of field usage: inherently the area of actual contact tends to be small, thus oxidation and other contamination degrade areas not in actual contact; and over time, with repeated decoupling and recoupling, stress relaxation in the metal plug contact material, which is typically brass, along with wearing away of both plug and socket material, frequently renders the connection loose, easily decoupled by accident, and prone to intermittancy and damage from arcing, thus generally unreliable and hazardous. In reaction to such problems, there has been a trend for safety regulatory agencies to disapprove connector types which fail to provide a positive, reliable method of contact and to mandate at least some form of locking means to prevent accidental decoupling under rigorous service conditions. Even when fitted with locking means, for example of the bayonet type, and whether or not bifurcated and prestressed, connectors of the known type utilizing parallel cylindrical surfaces as the major contact area inherently fail to provide positive contact presssure over the entire intended contact surface area, and this failure worsens with decoupling and recoupling, so that the reliability of such connectors generally fall far short of a satisfactory level.

SUMMARY OF THE INVENTION

It is a primary object of the present invention to provide a high current electrical connector in a novel configuration having a pair of mating members adapted to be readily coupled and locked together through a twisting action, and to be capable of frequent decoupling and recoupling without degradation.

It is a further object of the invention to provide an interfacing configuration between the mating members having a large area of electrical contact and providing uniform contact pressure throughout the contact area.

It is a still further object that the aformentioned configuration provide automatic compensation for wearing away of metal material in the contact interface region, so as to preserve the excellent contact integrity during repeated usage over an extended time period.

These and other objects have been achieved in the present invention which will be understood through study of the following drawings and description.

DETAILED DESCRIPTION

Figure 1:
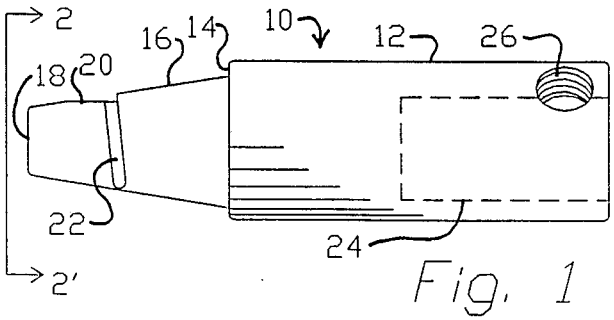
FIG. 1 is a side elevation of a first mating member of a connector pair in accordance with the present invention.

In the side elevation shown in FIG. 1, a first member 10 of a connector in accordance with this invention is shown having a cylindrical portion 12 with parallel sides in profile, stepping down slightly in diameter at step 14 to a cone-shaped tapered plug portion 16 which provides a contact surface decreasing uniformly in diameter to end 18. The surface of the tapered plug portion 16 is recessed to provide a flat shelf region 20 adjoining a groove 22 defining a spiral-helical path approximately half way around. Near the right hand end is seen the outline of a cylindrical cavity 24 for receiving a cable end, and a threaded hole 26 for accepting a set screw.

Figure 2:
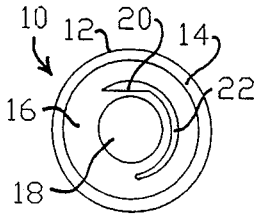
FIG. 2 is an end view of the member shown in FIG. 1 as viewed from a vantage point to the left.

In the left end view of FIG. 2, the tapered plug portion 16 is seen, concentric with the cylindrical portion 12, decreasing in diameter from step 14 to circular end area 18. Also seen is shelf region 20 and adjoining groove 22.

Figure 3:
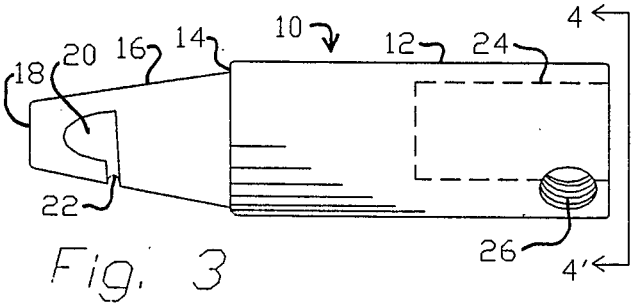
FIG. 3 is a plan view of the member shown in FIG. 1.

In FIG. 3, a plan view shows the surface area of the flat shelf region 20 and adjoining groove 22, between step 14 and circular end 18.

Figure 4:
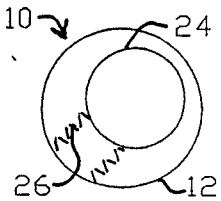
FIG. 4 is an end view of the member shown in FIG. 3 as viewed from a vantage point to the right.

In the right end view of FIG. 4, cylindrical cavity 24 is seen as non-concentric with cylindrical region 12, with threaded set screw hole 26 disposed radially through the thickest wall region.

Figure 5:
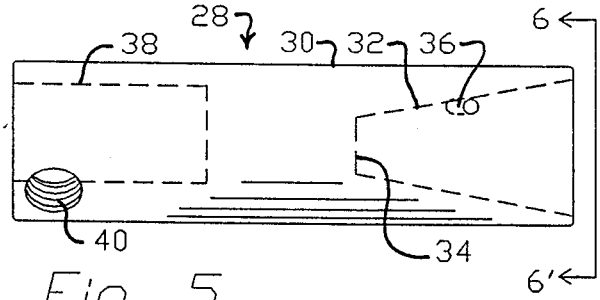
FIG. 5 is a side elevation of a second mating member of a connector pair in accordance with the present invention.

In the side elevation shown in FIG. 5, a second member 28 of a connector in accordance with this invention is shown having a cylindrical exterior 30, and beginning at slightly reduced diameter at the right hand end, a tapered socket cavity 32, shown in dashed outline, decreasing uniformly in diameter to a circular wall 34, provides a contact surface of complementary conical shape to mate with the contact surface of tapered plug portion 16 (FIG. 1). A pin 36 is disposed so as to protrude into the socket cavity 32 as shown. At the left end is seen a cylindrical cavity 38 shown in dashed outline, for receiving a cable end, and a threaded hole 40 for receiving a set screw to retain the cable end.

Figure 6:
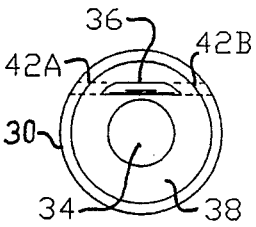
FIG. 6 is an end view of the member shown in FIG. 5 as viewed from a vantage point to the right.

FIG. 6, as viewed from the right of FIG. 5, shows the pin 36 secured in holes 42A and 42B in the wall surrounding socket cavity 38. Also seen is circular wall 34 at the far end of tapered socket cavity 38.

Figure 7:
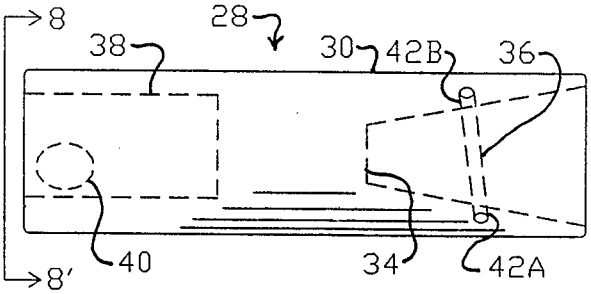
FIG. 7 is a plan view of the member shown in FIG. 6.

In FIG. 7, a plan view of the second member 28, pin 36, as positioned in holes 42A and 42B, is seen to be pitched at an angle, so as correspond with the pitch angle of groove 22 as seen in FIG. 1. Cylindrical cavity 38 and threaded set screw hole 40 appear in dashed outline.

Figure 8:
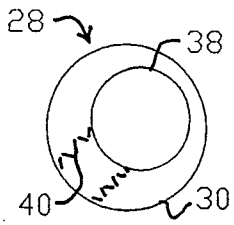
FIG. 8 is an end view of the member shown in FIG. 7 as viewed from a vantage point to the left.

In the right end view of member 28 shown in FIG. 8, cylindrical cavity 38 is seen as non-concentric with cylindrical exterior 30, with threaded set screw hole 40 disposed radially through the thickest wall region.

To mate the plug and socket members of the connector together, the plug member 12 oriented as in FIG. 3, the tapered portion 16 of plug member 10, oriented as in FIG. 1 and FIG. 2 as reference, is inserted into the cavity region 32 of socket member 28, oriented as shown in FIG. 5 and FIG. 6, such that the flat region 20 on the tapered portion 16 of plug member 10 is substantially parallel to pin 36 of socket member 28, providing clearance to allow insertion to a point where pin 36 (FIGS. 5 and 6) becomes aligned with the beginning of groove 20 (FIG. 1 and 2). Then with a right threading action between the two members of approximately a quarter turn, in this instance assuming socket member 28 is rotated from the orientation of FIG. 5 to that of FIG. 7, the thread groove 20 engages pin 36 and draws the two members together until tapered portion 16 seats against tapered cavity 32, forming a contact interface.

Figure 9:
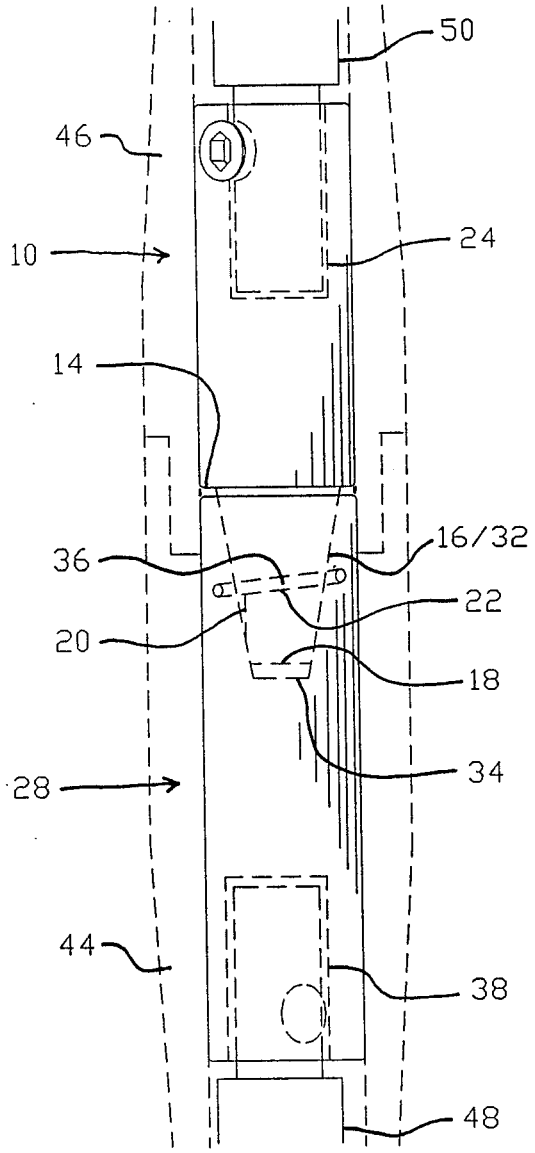
FIG. 9 shows the socket member of FIG. 7 mated with the plug member of FIG. 1, also showing an insulating sheath in dashed outline and cable ends inserted in the members.

FIG. 9 shows the resulting mated connector set comprising socket member 28, as in FIG. 7 mated with plug member 10 as in FIG. 1. Friction in the inclined plane of pin 36 against the confinement of thread groove 22 allows the connector set to be locked firmly in this relationship, where the contact surfaces of tapered plug portion 16 and socket cavity 32 becomes firmly clamped together in with strong uniform contact pressure over the large total interface contact area.

Referring to FIG. 9, clearance spacings to allow for machining tolerances and anticipated material wear are provided between the right hand end of socket member 30 and the step face 14 of plug member 10, and also between the end wall 34 of cavity 16 and the circular end 18 of the tapered portion 16 of plug member 10.

Typically, members 10 and 28 will be surrounded by an insulating sheath, which may be of a known type formed as two parts 44 and 46, made from resilient insulating material such as rubber, plastic or the like, suitable for hand gripping, indicated in dashed outline in FIG. 9 which also indicates the position of two cable ends 48 and 50, inserted in cavities 38 and 24.

In practicing this invention to couple the two members 10 and 28, they are grasped one in each hand by their surrounding sheath parts 44 and 46, one in each hand. The conical region 16 of plug member 10 (FIGS. 1,2,3) is inserted into cavity 32 of socket member 28 (FIGS. 5,6,7), and the two members are urged together while being twisted relative to each other in a right hand clockwise direction. Usually, insertion will be initially constrained by pin 36 against the tapered surface of conical region 16; then, as rotation causes pin 36 to become aligned with ledge 20, an abrupt step of insertion movement occurs as pin 36 moves into the starting region of thread groove 22. Then, with further twisting, threading action of pin 36 in groove 22 draws the surfaces of conical region 16 and cavity 32 together in uniform contact. Then a final twisting torque locks the two members 10 and 28 frictionally bound together. Decoupling is readily accomplished in a reversal of the procedure described.

Any material wearing which may occur from repeated decoupling and recoupling will be automatically compensated by a slight increase in the total angle of relative rotation as the two members are twist locked together, with no degradation in the functioning of the connector since the locking torque as well as the active contact area remain substantially constant. The increase in the angle of twist over time is of no practical significance: it would most likely be so slight as to go unnoticed by operating personnel.

The entire contact interface surface 16/32 is subjected to a wiping effect as the two members are twisted relative to each other during each instance of decoupling and recoupling, thus tending to renew the contact area and to inhibit surface degradation due to oxidization and other environmental contamination.

It should be noted that the region of end 18 of the plug member is made to have a fully circular end shape as shown in FIG. 2: it is important for optimal performance and longevity of the connector to distribute the contact pressure as uniformly as possible over the conical interface contact area especially around both of the end regions, therefore no groove or flat should be allowed to extend to the end 18. Accordingly, the recessed locking region, comprising groove 22 and lead-in shelf 20 in FIGS. 1, 2 and 3, are located centrally along the length of the conical contact region 16 of plug member 10 as shown and are intentionally located at a substantial distance inward from both of the end boundaries of the conical interface contact area.

In an embodiment which is believed to be the best mode of practicing the invention, the members 10 and 28 are machined from freemachining brass, 1" in diameter for a connector rated at 200 amperes nominal; both members are 4" in total length. The tapered region 16 of plug member 10 is made 0.8" in diameter at step 14 and sloped at 9 degrees relative to the longitudinal axis, becoming approximately 7/16" diameter at end 18. The tapered cavity 32 of socket member 28 is made 0.790" at the open end, sloped at the same angle as the tapered region 16 of plug member 10 (9 degrees), extending to a depth of 1.3". The flat area of ledge 16 is approximately ⅜" in length. Pin 36 and mounting holes 42A and 42B are ⅛" in diameter; pin 36 is made from roll-formed stainless steel and may be retained in place by press fitting and/or staking at both ends. Thread groove 22 is sized to provide a clearance fit around pin 36. Groove 22 and pin 36 are inclined from perpendicular at a pitch angle of 6 degrees.

Cable end cavities 24 and 38 are made ⅝" in diameter and ⅞" in depth. Set screw holes 26 and 40 are sized and threaded to accept a standard ½" set screw.

The invention may be practiced within a wide range of dimensional tolerance; for example the connector members could be scaled down to ¾" diameter to provide a nominal rating of 100 amperes.

Also there are a number of alternative metals and alloys which may be suitable in place of the brass and steel as described.

The invention may be embodied in still other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A connector for electric cables, comprising in combination:

a conductive plug member, attachable to a cable, providing a contact surface on a solid truncated cone-shaped projecting portion decreasing in diameter to a fully circular end;

a conductive socket member, attachable to a cable end, adapted to receive the projecting portion of said plug member in a solid-walled cone-shaped cavity providing a complementary contact surface adapted to mate uniformly against the contact surface of said plug member; and locking means comprising (a) a thread groove of U-shaped cross section and a contiguous flattened partially recessed lead-in shelf, formed integrally in said plug member, the thread groove and lead-in shelf being located entirely within the contact surface substantially distanced from boundaries of the contact surface, and (b) a cylindrical metallic thread groove engagement pin, incorporated in said socket member, disposed so as to protrude transversely into the cavity in a chordal relationship to a circular cross section thereof, located and pitched so as to threadedly engage the groove in said plug member in a manner whereby said contact surfaces are strongly urged against each other and are caused to become securely engaged in response to a twisting force applied between said members.

2. The connector as defined in claim 1 wherein said thread groove is made to extend a predetermined amount beyond a normal locking position of said thread groove engagement means as an allowance for material wearing.

3. The connector as defined in claim 2 wherein thread groove is made to extend approximately one half revolution, and said thread groove engagement means is located such that twist-lock coupling is accomplished with approximately a quarter revolution of rotation between said members.

4. The connector as defined in claim 1 wherein said thread groove includes a lead-in ledge region providing clearance for said pin to enter said groove.

5. The connector as defined in claim 1 wherein said members are machined from free-machining brass rod stock and said pin is roll formed from stainless steel.

6. The connector as defined in claim 1 in which each of said members include cable attachment means comprising a cylindrical cavity, at one end of a main body region of the member, adapted to receive a wire end of a cable, and a set screw, located in a threaded hole in a wall of the cavity, adapted to secure the wire end in place within the cavity.

7. An improved locking system in a readily disconnectable electrical connector pair of the type in which a tapered extension of a plug member matingly contacts a complementary shaped cavity region of a socket member over an interfacing surface having generally a truncated conical shape, the improved locking system comprising;

a cylindrical metallic pin, incorporated in the socket member, defining within the cavity a protrusion, disposed chordally relative to a circular cross section of the cavity so as to co-operate in threaded engagement with a thread groove of U-shaped cross section recessed in the plug member extension, in a manner enabling removable securing together of the pair in a twist-lock mode;

the thread groove and an associated lead-in shelf being located entirely within a central region of the interfacing surface, substantially distanced from boundaries of the interfacing surface; whereby the plug member is made to have a fully circular cross sectional shape in an end region thereof, and is thus enabled to fully and uniformly contact a corresponding region of the socket member cavity.

* * * * *